US011643780B2

(12) United States Patent
Eerikäinen

(10) Patent No.: US 11,643,780 B2
(45) Date of Patent: May 9, 2023

(54) BLOWING EQUIPMENT FOR DOCTOR EQUIPMENT OF A FIBER WEB MACHINE AND FIBER WEB MACHINE DOCTOR EQUIPMENT EQUIPPED WITH BLOWING EQUIPMENT

(71) Applicant: Valmet Technologies, Inc., Espoo (FI)

(72) Inventor: Hannu Eerikäinen, Varkaus (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 0 days.

(21) Appl. No.: 17/482,216

(22) Filed: Sep. 22, 2021

(65) Prior Publication Data

US 2022/0098795 A1 Mar. 31, 2022

(30) Foreign Application Priority Data

Sep. 25, 2020 (FI) ..... 20205930

(51) Int. Cl.
*D21G 3/00* (2006.01)

(52) U.S. Cl.
CPC ..... *D21G 3/005* (2013.01)

(58) Field of Classification Search
CPC ..... D21G 3/005; D21G 3/04; D21G 3/00; D21G 9/00; D21G 9/0063; B05C 11/04; D21H 23/34; G03G 21/0011
See application file for complete search history.

(56) References Cited

U.S. PATENT DOCUMENTS

2006/0180291 A1* 8/2006 Rata ..... D21G 3/005 118/414
2010/0325912 A1* 12/2010 Auranen ..... D21G 3/04 34/117

FOREIGN PATENT DOCUMENTS

DE 4108167 A1 * 9/1992 ..... 15/93.1

* cited by examiner

*Primary Examiner* — Eric Hug
*Assistant Examiner* — Matthew M Eslami
(74) *Attorney, Agent, or Firm* — Stiennon & Stiennon

(57) ABSTRACT

Blowing equipment (10) for doctor equipment of a fiber web machine (10) includes a distribution channel (11), the length of which corresponds essentially to the length of the doctor equipment (40). The blowing equipment (10) also includes nozzle devices (12) for directing blowing in the doctor equipment (40). The nozzle devices (12) are arranged to be adapted to a blade holder (13) that belongs to the doctor equipment (40) for establishing doctor blowing. The distribution channel (11) is adapted to be fastened to the blade holder (13). The invention also relates to doctor equipment of a fiber web machine, where the doctor equipment is equipped with blowing equipment.

16 Claims, 6 Drawing Sheets

BLOWING EQUIPMENT FOR DOCTOR EQUIPMENT OF A FIBER WEB MACHINE AND FIBER WEB MACHINE DOCTOR EQUIPMENT EQUIPPED WITH BLOWING EQUIPMENT

CROSS REFERENCES TO RELATED APPLICATIONS

This application claims priority on Finnish App. No. 20205930, filed Sep. 25, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to blowing equipment for doctor equipment of a fiber web machine, which blowing equipment includes a distribution channel, the length of which corresponds essentially to the length of the doctor equipment, and nozzle devices for directing blowing in the doctor equipment, and the nozzle devices are arranged to be adapted to a blade holder belonging to the doctor equipment for establishing doctor blowing. The invention also relates to doctor equipment of a fiber web machine, where the doctor equipment is equipped with blowing equipment.

FIG. 5 shows an example of the location of blowing equipment in a fiber web machine, such as in a paper, board, and tissue machine. Doctor blowing is established with the blowing equipment. The blowing equipment is adapted in the doctor equipment 40, which is located on the last drying cylinder 46 of a cylinder drying group. At this point, the fiber web is run down into a pulper 42. Doctor blowing is used for ensuring that the fiber web W comes off from the surface of the drying cylinder 46. There are also other critical positions even elsewhere in the fiber web machine, such as when the grammage of the fiber web increases after coating and the features of the fiber web change. Blowing equipment is especially necessary when a certain grammage is exceeded at a certain speed. As an example, a light-weight fiber web with a grammage of less than 100 grams still comes off at a speed of 1300 meters per minute without doctor blowing, while a fiber web of more than 200 grams requires doctor blowing at a speed of as low as 1000 meters per minute. The design limits may vary depending on a specific machine and fiber product. A single fiber web machine may have about 10 doctor equipment equipped with blowing equipment.

Prior art blowing equipment includes an air pipe that forms a distribution channel, which air pipe is fastened to a beam that supports the doctor equipment, beneath the beam. The air pipe extends essentially across the entire length of the doctor equipment. Nozzle devices have correspondingly been arranged in a blade holder at a distance from one another to establish doctor blowing. There is a separate distribution pipe for each nozzle device. In other words, there is a separate distribution pipe from the air pipe to each nozzle device. Air is supplied into the air pipe and from it to the nozzle devices via distribution pipes.

The air pipe and the distribution pipes require much installation space. Moreover, the air pipe and the distribution pipes are susceptible to breakage, and they gather loose material easily on their surface. The entire doctor beam has to be removed for the maintenance of the blowing equipment and for the adjustment of the nozzle devices, and this requires the stopping of production. On the other hand, the utilization of the blowing equipment in itself requires a doctor beam.

SUMMARY OF THE INVENTION

The object of the present invention is to accomplish a novel kind of blowing equipment for the doctor equipment of a fiber web machine, which blowing equipment is more compact and efficient than before, but of a lighter weight and simpler than before. The characteristic feature of the blowing equipment according to this invention is a distribution channel adapted to be fastened to a blade holder. Another object of the present invention is to accomplish a novel kind of doctor equipment of a fiber web machine, where the doctor equipment is equipped with blowing equipment, which doctor equipment is easier to use and of a lower cost than before and also quicker to adjust and maintain than before. The one characteristic feature of the doctor equipment according to the invention is that a distribution channel is fastened to the blade holder. In the blowing equipment according to the invention, the distribution channel is implemented in a novel and surprising manner. In this way, the structure of the blowing equipment can be made compact. At the same time, doctor blowing can be added easily to existing doctor equipment.

Moreover, the doctor blowing can be maintained and adjusted even during production. Furthermore, the doctor blowing can be implemented into various types of doctor equipment, and the blowing equipment itself contains few components.

BRIEF DESCRIPTION OF THE DRAWINGS

The invention is described below in drawings that illustrate an embodiment of the invention.

DESCRIPTION OF THE PREFERRED EMBODIMENTS

Figure 1:
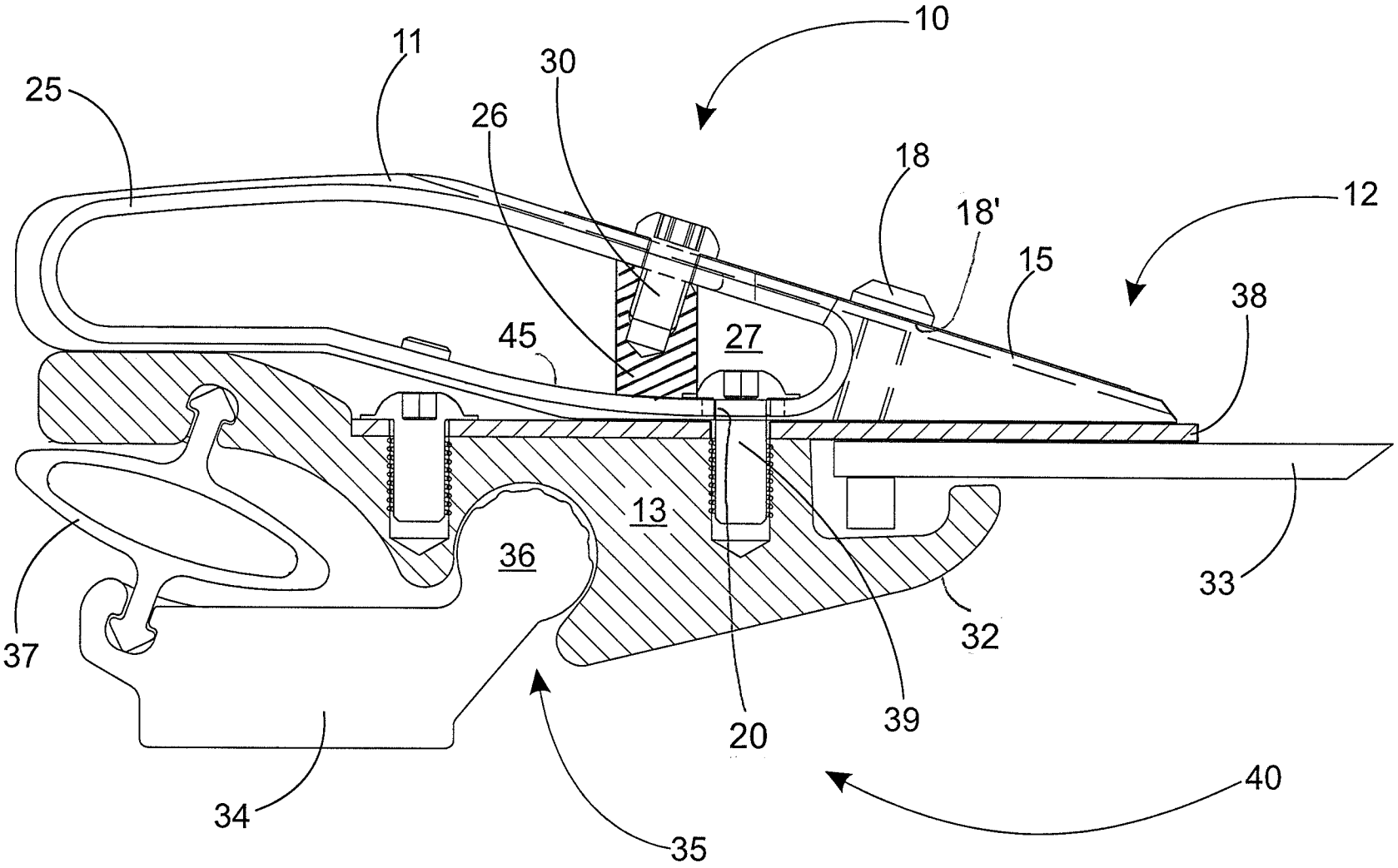
FIG. 1 shows doctor equipment equipped with blowing equipment according to the invention viewed from an end.

FIG. 1 shows blowing equipment according to the invention, which blowing equipment is primarily intended for doctor equipment of a fiber web machine. The doctor equipment can include at least the doctor blade and the doctor blade holder. The doctor equipment is used for ensuring that the fiber web produced comes off a roll, drying cylinder or equivalent surface, as shown in principle in FIG. 5. At the same time, the doctor equipment is used for removing material from the surface doctored e.g. the roll surface, and for maintaining the surface roughness of the surface doctored. A doctor blow is also arranged as part of the doctor equipment primarily so as to ensure that the fiber web comes off the roll surface, which is doctored. The doctor blow opens so as to blow air in the machine direction toward the surface doctored. The doctor blade extends along the full width in the cross machine direction of the of the surface in the fiber web machine which is doctored, in other words in the longitudinal direction of the doctor equipment. The doctor blow is directed to the front side i.e., the side facing the doctored web, of the doctor blade, so that the doctor blow makes the fiber web come off before the doctor blade, which can hence remove material in an undisturbed manner from the surface doctored. The blowing equipment 10 includes a distribution channel 11, the length of which corresponds essentially to the length of the doctor equipment, and nozzle devices 12 for directing blowing air in the doctor equipment. The nozzle devices 12 are arranged to be adapted to a blade holder that belongs to the doctor equipment, for establishing doctor blowing. In this way, the blowing that opens from the nozzle devices is advantageously directed precisely to the point where the fiber web comes off. According to the invention, a distribution channel 11 is adapted to be fastened to the blade holder 13. In this case, separate distribution pipes are unnecessary, and the blowing equipment can be adapted to many kinds of doctor equipment. At the same time, the size and mass of the blowing equipment are reduced, whereby separate beams can be omitted, which further reduces the costs. Structures that are susceptible to breakage and fouling are also omitted.

Figure 5:
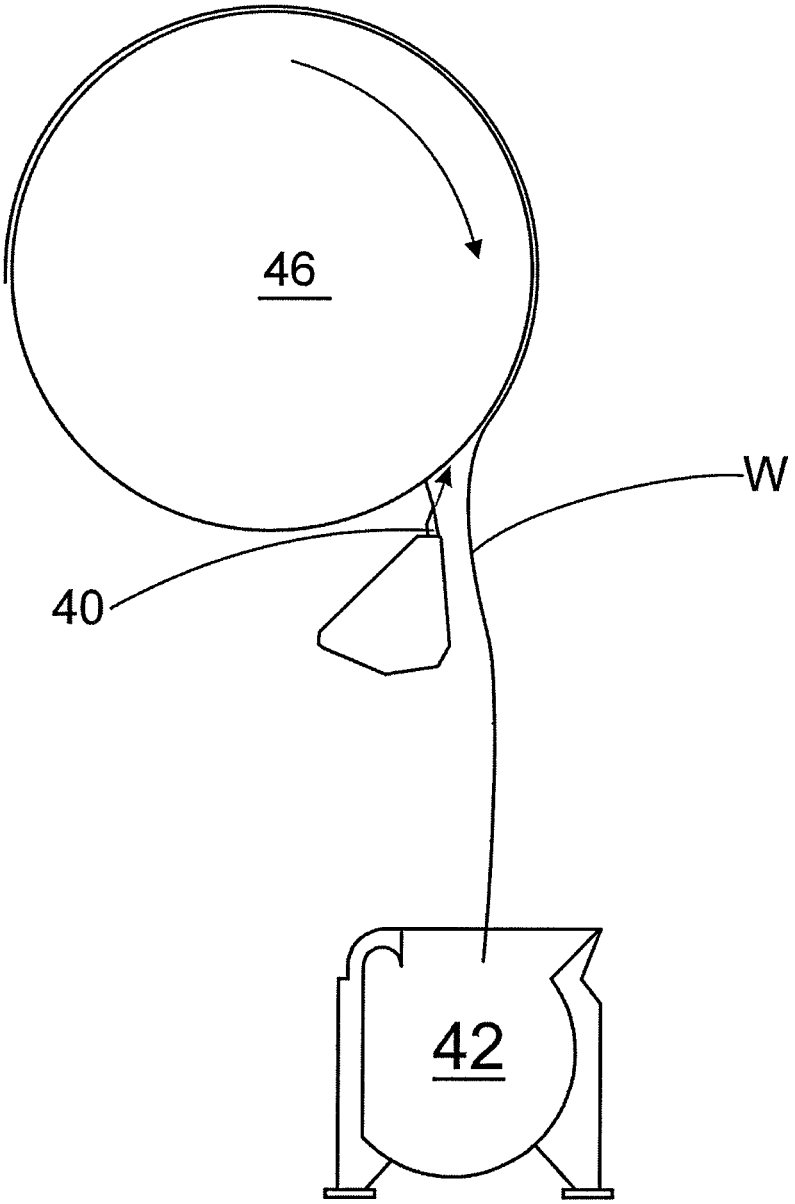
FIG. 5 shows an example position for the doctor equipment according to the invention.

In accordance with FIG. 1, the distribution channel 11 has a wedge-like cross section, e. g. narrows on a side closest the nozzle devices 12. In this way, the accumulation of material on top of the blowing equipment is avoided. At the same time, the progress of the fiber web remains undisturbed, for example, when running down the fiber web (FIG. 5). The distribution channel 11 is advantageously an extruded metal piece which defines a frame 41, which is adapted to extend essentially across the entire length of the blade holder 13. By means of extrusion, the distribution channel 11 can be easily given the desired shape, and at the same time the distribution channel can be made uniform across the entire length needed. On the other hand, the distribution channel 11 can be formed, for example, from two parts that are joined together at their ends. Air is advantageously supplied from both ends of the distribution channel 11, in which case the air flow is distributed as evenly as possible. When manufactured from two or more parts, the blowing equipment can be transported easily to the place of use. At the same time, the manufacture and machining of the distribution channel are facilitated.

The metal piece frame 41 is most suitably of aluminum, which is well applicable to extrusion. Moreover, aluminum is of light weight and easily machinable. Aluminum can also withstand the harsh conditions of a fiber web machine even without surface treatment. However, a Polytetrafluoroethylene (PTFE) coating is advantageously used. This protects aluminum against corrosion and facilitates it staying clean and its cleaning.

Figure 2A:
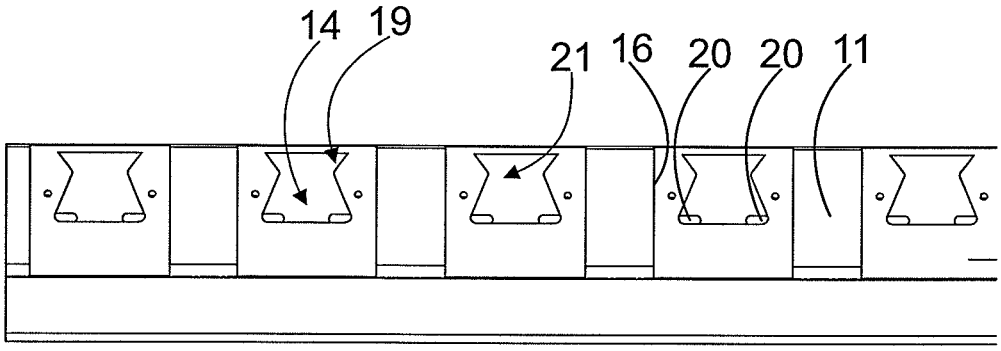
FIG. 2*a* shows a distribution channel according to the invention viewed from above.
Figure 2B:
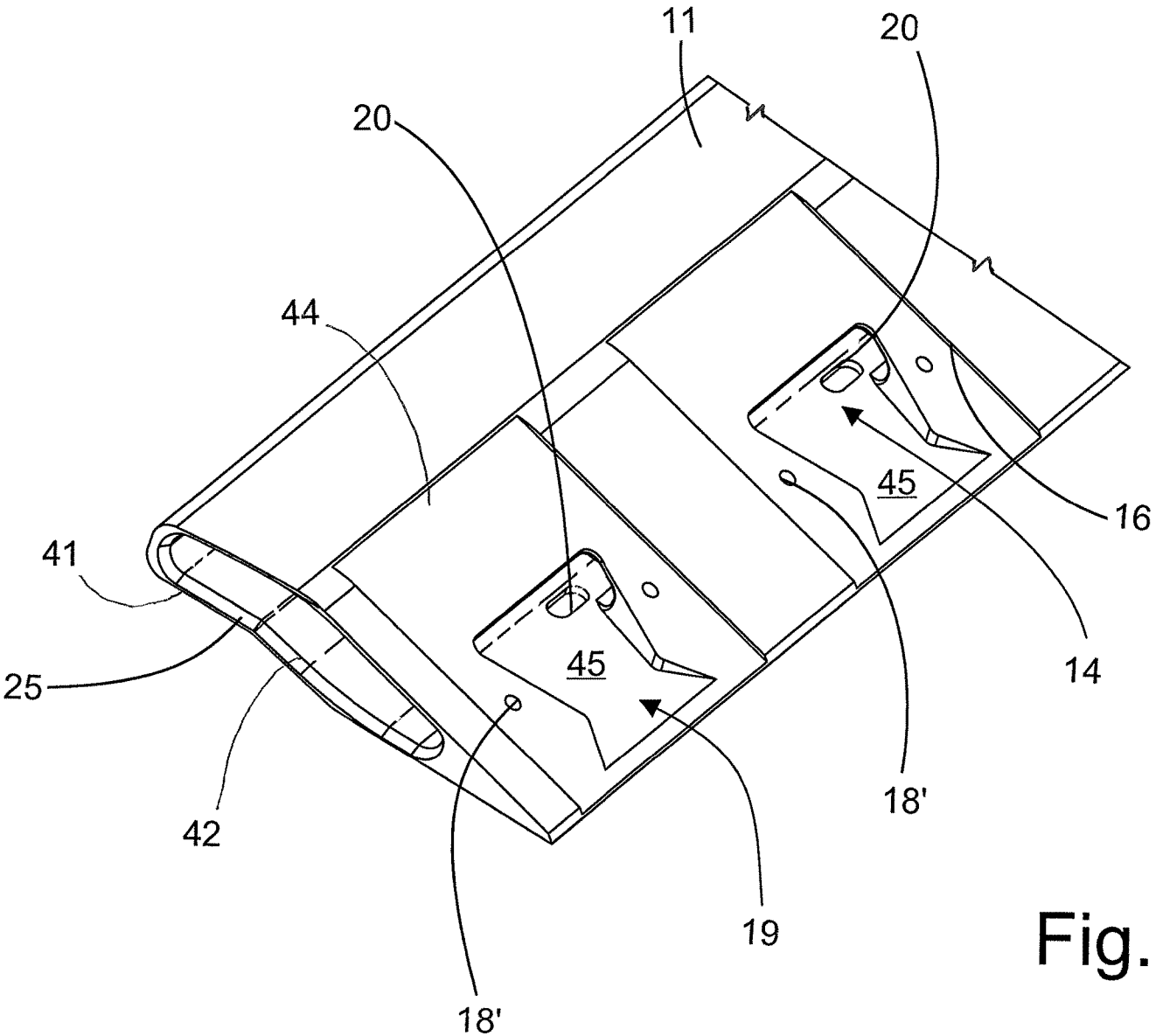
FIG. 2*b* shows an end section of the distribution channel of FIG. 2*a* in a fragmentary axonometric view.
Figure 3:
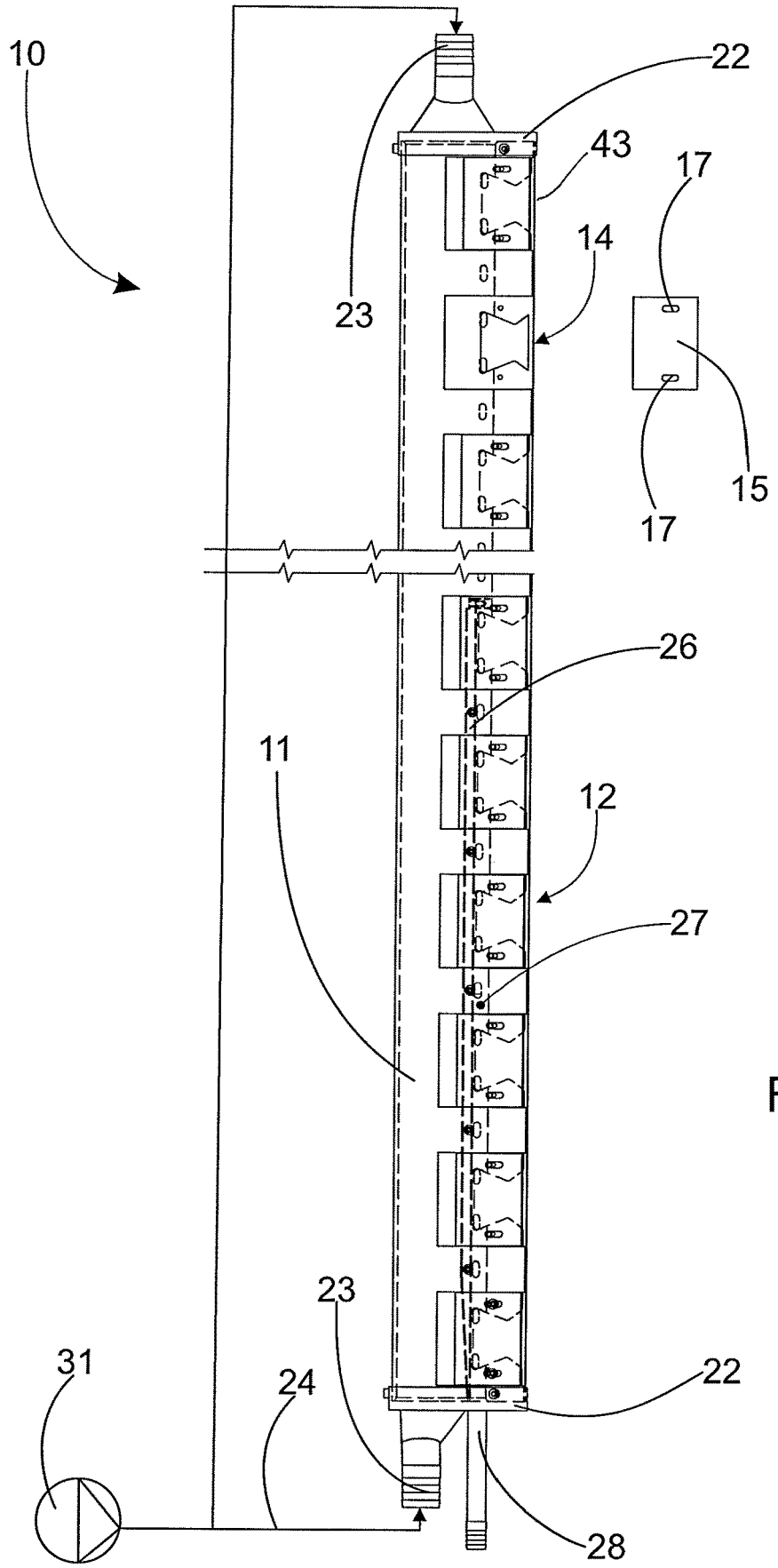
FIG. 3 shows the blowing equipment according to the invention viewed from above.

The blowing equipment according to the invention is compact. The wedge-like shape alone accomplishes a flat structure. At the same time, the distribution channel 11 frame 41 can be given a sufficient cross-sectional area of the flow, whereby the doctor blowing can be made sufficiently efficient. Moreover, the nozzle devices 12 are advantageously integrated into the distribution channel 11. In this way, separate distribution pipes are unnecessary, and the mass of the blowing equipment remains small. More specifically, the nozzle devices 12, as shown in FIG. 2*b*, are formed from several nozzle openings 14 that have been machined in the distribution channel 11 frame 41 at a distance from one another. After extrusion, the distribution channel 11 is complete in terms of its external shape and internal flow channel 42 which is defined by the internal shape of the distribution channel, whereby the nozzle openings can be machined easily in the aluminum piece. The frame 41 has an inner wall 45 within the flow channel 42 and an outer wall 44 external to the flow channel. At the same time, an independent adjustment plate 15 can be adapted in a nozzle opening 14. Each adjustment plate 15, as shown in FIG. 3, is fixed to the distribution channel frame 41 to overly a nozzle opening 14 allowing the air blow to escape from the nozzle device 12 between the adjustment plate 15 and the distribution channel frame. In this case, the flow characteristics of each nozzle device 12 formed by the nozzle opening 14 and the plate 15 can be adapted to be those desired. In other words, the distribution channel 11 includes adjustable nozzle elements 15 in the nozzle devices 12. FIG. 3 shows one adjustment plate 15 separate from the blowing equipment 10. As an example, a more intense doctor blowing can be directed, if necessary, to the edges of the fiber web than to the center part, by adjusting the nozzle devices. In this way, it can be ensured that the fiber web comes off. In machining, material is removed from the extruded piece frame 41 forming the distribution channel 11. Advantageously at the location of the nozzle opening 14, there is a recess 16 in the distribution channel 11 as shown in FIG. 2*b* which matches and receives the adjustment plate 15. In this case, the mass of the extrusion forming the distribution channel 11 is reduced further, and at the same time a suitable space is obtained for the adjustment plate 15. In this way, the amount of loose material collected by the adjustment plate is small, and the adjustment plate remains in the correct position, whereby the nozzle gap 43 remains straight. In the application presented, the adjustment plate 15 has two oval holes 17, which enable the moving of the adjustment plate and hence the adjustment of the nozzle gap 43 by loosening or tightening the fastening screws 18, with which the adjustment plate 15 is fastened to the distribution channel 11. There are threaded holes 18' in the distribution channel for the fastening screws. By means of the adjustment possibility, doctor blowing can be easily profiled over the length of the doctor equipment, in other words in the cross machine direction of the fiber web machine, and at the same time it is also possible to optimize the need for air supply. Air is advantageously supplied from both ends of the distribution channel, whereby air is distributed evenly across the entire distance of the doctor equipment. In this way, by adjusting the nozzle gaps 43, the air flow and mass flow and hence the doctor blowing can be adjusted as desired.

The nozzle devices form a simple nozzle gap 43, the size of which can be adjusted by the adjustment plate 15 as shown in FIG. 3. In FIGS. 2*a* and 2*b*, the structure of the distribution channel is presented before the installation of the adjustment plates 15 into place. The adjustment plates 15 and oval holes 17 are so dimensioned that even with the smallest adjustment, there is always a gap 43 that ensures doctor blowing across the entire width of the doctor equipment. In the application presented, the nozzle opening 14 has a shaping 19 of the frame 41 outer wall 44, where there is a narrowing 21 of the nozzle opening 14 in the flow direction. In this case, it is possible to increase the flow velocity of the air supplied from the distribution channel into the nozzle opening 14, which intensifies blowing. Hence, even a heavy fiber web is sure to come off from the surface of a drying cylinder, for example. At the same time, the air supply is sufficient.

In accordance with FIG. 3, the distribution channel 11 includes an end piece 22, which has a connection 23 for an air hose 24 or equivalent. In this case, it is possible to easily fasten a normal hose 24 or other channel even to the wedge-like distribution channel 11 for the supply of air. For the positioning of the end piece 22, there is a bevel 25 at the end of the distribution channel 11, in which case the end piece settles tightly into place. The end piece 22 can be of plastic, for example.

The lower part of FIG. 3 shows a special solution, which ensures tail threading that is used at the beginning of the manufacture of the fiber web. In tail threading, a narrow strip of the fiber web is taken through the fiber web machine, after which the tail threading strip is spread to a full-width fiber web. In accordance with FIG. 3, there is an intermediate structure 26 at one end of the distribution channel 11 bordering and forming an auxiliary channel 27. The auxiliary channel 27 is also shown in FIG. 1. Moreover, the auxiliary channel 27 includes an air supply connection 28 of its own for the establishment of an adjusted flow, such as edge blowing. With the solution presented, a really efficient doctor blowing is accomplished in the tail threading area, which doctor blowing makes the tail threading strip come off and guides it to the desired direction. In this way, tail threading succeeds at once, which shortens production interruptions. In other words, the starting of production is quick. During tail threading, the full-width doctor blowing is switched off, whereby, if necessary, the entire air flow can be directed to the tail threading area connected to the auxiliary channel 27. The intermediate structure 26 that is illustrated with a thick broken line here extends over the distance of six nozzle openings. The intermediate 26 structure is shaped in accordance with the flow channel, and moreover, an end guide 29 and the end piece 22 together with the intermediate structure 26 seal a separate channel in the tail threading area. The air connection 23 and the air supply connection 28 are advantageously adapted in the same end piece 22.

Figure 4A:
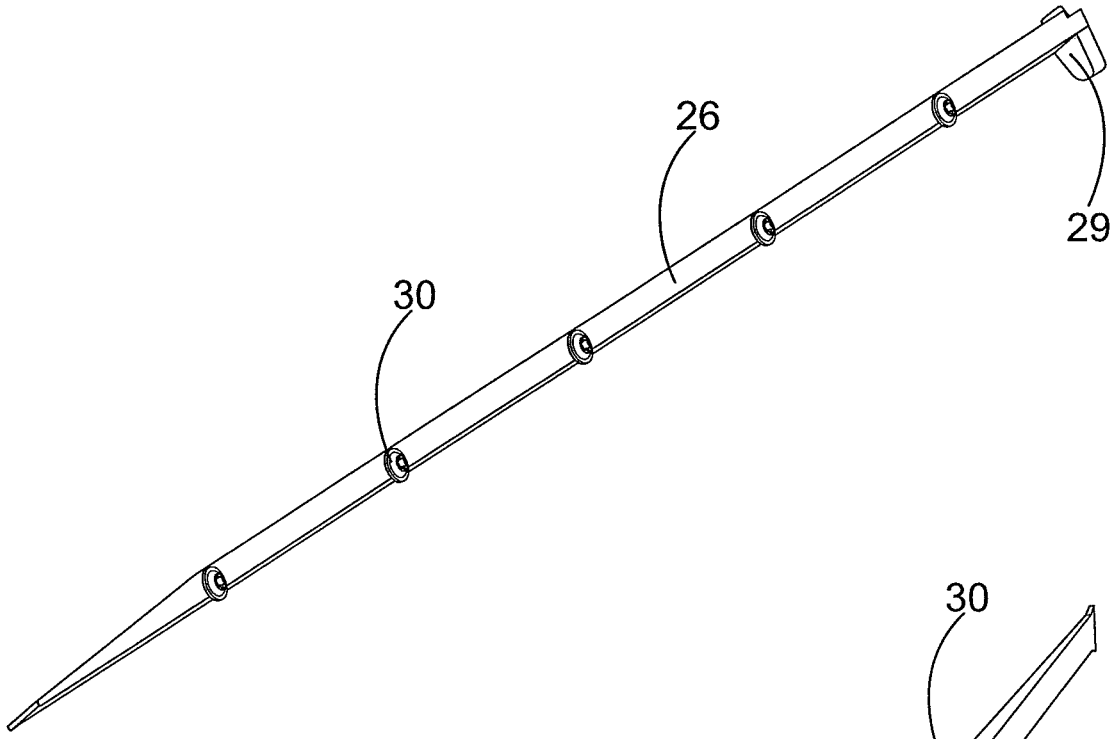
FIG. 4*a* shows the blowing equipment according to the invention viewed from a first direction of an intermediate structure of the distribution channel.
Figure 4B:
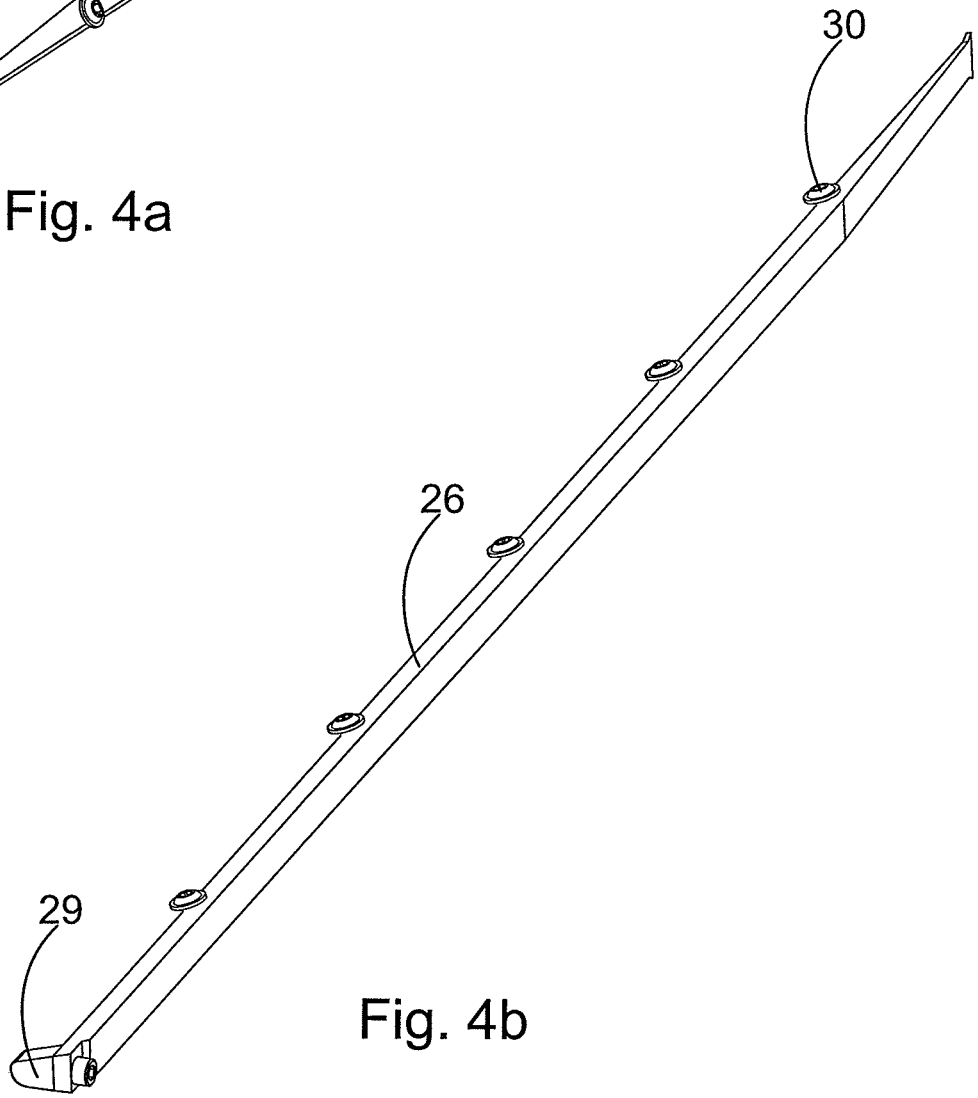
FIG. 4*b* shows the intermediate structure of FIG. 4*a* from a second direction.

The intermediate structure 26 is also shown in FIG. 1, where it is fastened to the distribution channel 11 by means of a screw 30. In FIGS. 4*a* and 4*b*, the intermediate structure 26 is shown from two different directions. The screws 30 used for fastening here are already in the intermediate structure 26.

The structure of the blowing equipment becomes even simpler especially by utilizing a shaped nozzle opening 14. The blowing equipment advantageously includes a compressor 31, the output of which is limited to 5-10 bar. In this case, even a simple pressure-generating device accomplishes a sufficient air flow for the establishment of efficient doctor blowing. At the same time, the blowing equipment can be adapted even in existing doctor equipment, in which case the doctor blowing can be added, if necessary, quickly and easily in a fiber web machine.

FIG. 1 shows the doctor equipment 40 of a fiber web machine, where the doctor equipment is equipped with blowing equipment. Here, the doctor equipment includes a blade holder 13 for a doctor blade 33. The holder 13 comprises an upper jaw and a lower jaw 32, between which the doctor blade 33 is placeable. The upper jaw can be a uniform part of the holder 13 or, like in FIG. 1, it can be composed of a separate press plate 38. The blade holder 13 can be of fiber-reinforced plastic composite or, for example, of aluminum, such as in this application. Moreover, the blowing equipment 10 includes a distribution channel 11 as well as nozzle devices 12 fastened to the blade holder 13 for the distribution of air in the doctor equipment and hence for directing blowing in the doctor equipment. According to the invention, the distribution channel 11 is fastened to the blade holder 13. In FIG. 1, the distribution channel 11 is screwed to the blade holder 13, in which case, in operating condition, the entire blowing equipment that comprises both the nozzle devices and the distribution channel is tightly fastened to the blade holder. In this case, the doctor blowing opens in the direction of the doctor blade, hitting the surface doctored before the doctor blade. The application presented utilizes the frontmost screws 39 of the press plate 38, with which screws 39 both the press plate 38 and the distribution channel 11 are fastened to the blade holder 13. In this case, the blowing equipment can be adapted to the doctor equipment without changing the structure of the doctor equipment. The openings 20 for the screws are illustrated in FIGS. 2*a* and 2*b*.

Irrespective of the doctor equipment, the above-described blowing equipment is used. A significant additional advantage is achieved when a certain type of doctor equipment is used. Advantageously for supporting the blade holder 13, the doctor equipment 40 includes a body piece 34, and there is a form-locking hinge 35 between the blade holder 13 and the body piece 34, which hinge 35 allows the blade holder 13 to be pulled out of the doctor equipment. Exactly such doctor equipment is shown in FIG. 1. The body piece 34 is fastened to the structure of the fiber web machine or to the doctor beam such as illustrated in FIG. 5. The body piece 34 has a bulge 36, and there is a corresponding shape or recess in the blade holder 13. This forms a hinge 35, which allows the turning of the blade holder, but keeps the blade holder 13 attached to the body piece 34. There is also a loading hose 37 between the body piece 34 and the blade holder 13, into which loading hose 37 compressed air is supplied. When pressurized, the loading hose 37 expands and turns the blade holder 13 and hence the doctor blade 33 against the surface doctored. The blade holder here is of aluminum, and a press plate 38 is fastened to its surface, which press plate 38 can be of fiber-reinforced polymer material or metal; the press plate 38 is most advantageously of spring steel. The loadability and durability of such a blade holder 13 are good, in which case the doctor equipment remains operational even on heavy fiber webs.

The above-presented blade holder 13 with its distribution channel 11 can be pulled out of the doctor equipment 40 even during production. In this way, the blade holder 13 and the distribution channel 11 can be cleaned easily and, if necessary, maintained and adjusted. At the same time, even the doctor blade 33 can be replaced. After this, the blade holder 13 with its distribution channel 11 are pushed back into place.

The blowing equipment according to the invention is simple but efficient. Moreover, the mass of the distribution channel itself is small, in which case it can be supported on existing doctor equipment and even on blade holders. The mass per meter of the blowing equipment is 1000-2000 grams depending on the needed cross-sectional area of the flow. The doctor blowing is naturally located at the correct place, and the distribution channel 11 can fit even into narrow positions. The length of the distribution channel 11 is several meters, even up to 10 meters. There are on average five to ten nozzle devices 12 per length meter. Air flows that discharge from several parallel nozzle devices 12 converge, establishing a comprehensive and efficient doctor blowing. Due to the compact and light-weight structure, the blowing equipment can be placed even in existing doctor equipment without additional supporting. Moreover, efficient blowing can be accomplished in a simple manner in the tail threading area.

I claim:

1. A doctor device in a fiber web machine, comprising:

a doctor blade mounted in a doctor blade holder, the doctor blade having a length which is arranged to extend in a cross-machine direction along a fiber web engaging part of a fiber web machine, wherein the doctor blade extends in a machine direction toward the fiber web engaging part of the fiber web machine;

a frame defining a distribution channel connected to a source of compressed air, wherein the frame with the distribution channel is mounted to the blade holder and extends along the length of the doctor blade; and portions of the frame which define a plurality of outlets positioned to discharge air from an interior of the distribution channel onto the doctor blade, wherein each of the plurality of outlets has an overlying adjustment plate which is adjustably mounted to the frame to define a plurality of air nozzles communicating with the distribution channel and arranged to blow along the doctor blade in the machine, wherein each adjustment plate is independently adjustable in the machine direction to cover a greater or lesser portion of its underlying outlet allowing profiling air blowing in the cross-machine direction of the fiber web machine; and wherein there is an intermediate structure at one end of the distribution channel forming an auxiliary channel and wherein the auxiliary channel includes an air supply connection connected to a second source of compressed air such that the auxiliary channel supplies compressed air to second air nozzles which communicate with the distribution channel at said one end of the doctor blade.

2. The doctor device of claim 1 wherein the frame of the distribution channel has a wedge-like cross section.

3. The doctor device of claim 1 wherein the frame of the distribution channel is an extruded metal piece.

4. The doctor device of claim 3 wherein the metal piece is of aluminum.

5. The doctor device of claim 1 wherein the air nozzles are integrated into the frame of the distribution channel.

6. The doctor device of claim 5 wherein the air nozzles are formed from nozzle openings machined in the frame of the distribution channel at a distance from one another.

7. The doctor device of claim 1 wherein at the location of the nozzle openings there is a recess in the distribution channel which receives the adjustment plate.

8. The doctor device of claim 1 wherein the distribution channel includes an end piece which has a connection for an air hose which forms the source of compressed air.

9. The doctor device of claim 1 wherein the source of compressed air is a compressor the output of which is limited to a value between 5-10 bar.

10. An air blow device for mounting to a doctor device in a fiber web machine which has a doctor blade mounted in a doctor blade holder, the doctor blade extending in a cross-machine direction alongside a roll, wherein the doctor blade has a length and extends in a machine direction toward the roll and has a front side which faces the web as it approaches the doctor blade, the air blow device comprising:

a tubular frame defining a distribution channel arranged to connect to a source of compressed air, wherein the tubular frame has an inner wall which faces the doctor blade and an outer wall which is spaced from and overlies the inner wall to form the distribution channel, and wherein the tubular frame is arranged to be mounted to the blade holder and extend along the length of the doctor blade in the cross-machine direction;

wherein portions of the outer wall define a plurality of outlets communicating with the distribution channel, the plurality of outlets spaced in the cross-machine direction to form a cross-machine direction row of outlets;

a plurality of adjustment plates adjustably secured to the tubular frame outer wall so that each adjustment plate overlies at least one corresponding outlet of the plurality of outlets, the plurality of adjustment plates spaced from one another in the cross-machine direction, wherein each adjustment plate is independently adjustable in the machine direction to cover a greater or lesser portion of the at least one corresponding outlet; and wherein the plurality of adjustment plates and the corresponding outlets of the plurality of outlets define a plurality of air nozzles communicating with the distribution channel and arranged to blow along the front side of the doctor blade to make the fiber web come off before the doctor blade, allowing air to escape from each air nozzle between the adjustment plate and the distribution channel frame.

11. The blowing device of claim 10 further comprising an end piece connected to the tubular frame, the end piece having a connection for an air hose, the air hose being a source of compressed air.

12. The blowing device of claim 10 further comprising an intermediate structure at one end of the distribution channel forming an auxiliary channel and wherein the auxiliary channel includes an air supply connection connected to a second source of compressed air such that the auxiliary channel supplies less than all of the plurality of air nozzles communicating with the distribution channel at one end of the doctor blade.

13. The air blow device of claim 10 wherein the lower wall of the tubular housing has portions defining a first slot positioned beneath the first outlet and a second slot positioned beneath the second outlet, and wherein a fastener extends through each slot for engagement with the underlying doctor blade holder, and wherein the first adjustment plate and the second adjustment plate are removable from the first outlet and the second outlet to allow access to the first slot and the second slot respectively, for access to the fasteners extending through the first and second slot for attachment of the air blow device to the blade holder.

14. The air blow device of claim 10 further comprising a recess in the outer wall adjoining each of the plurality of outlets, wherein each recess matches and receives one of the plurality of adjustment plates.

15. The air blow device of claim 10 wherein each adjustment plate has two oval holes extending in the machine direction, with fastening screws extending through the two oval holes into the outer wall of the tubular frame, such that each adjustment plate is movable by loosening or tightening the fastening screws.

16. The air blow device of claim 10 further comprising a doctor device in a fiber web machine which has a doctor blade mounted in a doctor blade holder, the doctor blade extending in a cross-machine direction alongside a roll, wherein the doctor blade has a length and extends in a machine direction toward the roll and has a front side which faces the web as it approaches the doctor blade, wherein the tubular frame is fixed to the doctor blade holder.

* * * * *